US006772903B1

(12) United States Patent
Riggins et al.

(10) Patent No.: US 6,772,903 B1
(45) Date of Patent: Aug. 10, 2004

(54) TRASH-RECEIVING SHOPPING BAG DEVICE

(76) Inventors: Brian Riggins, 1202 Talcott St., Sedro-Wooley, WA (US) 98284; Tina M. Riggins, 1202 Talcott St., Sedro-Wooley, WA (US) 98284; Graeme Riggins, 1202 Talcott St., Sedro-Wooley, WA (US) 98284

( * ) Notice: Subject to any disclaimer, the term of this patent is extended or adjusted under 35 U.S.C. 154(b) by 63 days.

(21) Appl. No.: 10/158,483

(22) Filed: May 31, 2002

(51) Int. Cl.[7] ..... B65D 25/10
(52) U.S. Cl. ..... 220/495.1; 220/495.08; 220/908.3
(58) Field of Search ..... 220/495.1, 495.08, 220/908.3

(56) References Cited

U.S. PATENT DOCUMENTS 816,989 A * 4/1906 Moler et al. ..... 220/495.1
4,418,835 A * 12/1983 Watts ..... 220/495.1
4,558,800 A * 12/1985 Isgar et al. ..... 220/495.1
4,728,070 A * 3/1988 Engelbrecht ..... 248/303
5,873,643 A * 2/1999 Burgess et al. ..... 312/290

* cited by examiner

*Primary Examiner*—Joseph Moy

(57) ABSTRACT

A trash-receiving shopping bag device for allowing the user to reuse the plastic bags received while shopping at retail stores. The trash-receiving shopping bag device includes a container having bottom and side walls, and also having an open top; and also includes a lid being hingedly attached to the container; and further includes a handle being attached to the lid; and also includes a plurality of shopping bag support members being attached to the side walls and being spaced above the bottom wall inside the container.

1 Claim, 3 Drawing Sheets

TRASH-RECEIVING SHOPPING BAG DEVICE

BACKGROUND OF THE INVENTION

1. Field of the Invention

The present invention relates to trash-receiving shopping bag containers and more particularly pertains to a new trash-receiving shopping bag device for allowing the user to reuse the plastic bags received while shopping at retail stores.

2. Description of the Prior Art

The use of trash-receiving shopping bag containers is known in the prior art. More specifically, trash-receiving shopping bag containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,285,927; U.S. Pat. No. 5,002,200; U.S. Pat. No. 5,511,691; U.S. Pat. No. 5,427,246; U.S. Pat. No. 5,042,687; and U.S. Pat. No. Des. 327,014.

While these devices fulfill their respective, particular objectives and requirements, the aforementioned patents do not disclose a new trash-receiving shopping bag device. The prior art discloses inventions having containers being used only for the purpose of storing plastic shopping bags.

SUMMARY OF THE INVENTION

The general purpose of the present invention, which will be described subsequently in greater detail, is to provide a new trash-receiving shopping bag device which has many of the advantages of the trash-receiving shopping bag containers mentioned heretofore and many novel features that result in a new trash-receiving shopping bag device which is not anticipated, rendered obvious, suggested, or even implied by any of the prior art trash-receiving shopping bag containers, either alone or in any combination thereof. The present invention includes a container having bottom and side walls, and also having an open top; and also includes a lid being hingedly attached to the container; and further includes a handle being attached to the lid; and also includes a plurality of shopping bag support members being attached to the side walls and being spaced above the bottom wall inside the container. None of the prior art describes a container being used to support shopping bags not for storage purposes but for using the shopping bags to receive trash.

There has thus been outlined, rather broadly, the more important features of the trash-receiving shopping bag device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new trash-receiving shopping bag device which has many of the advantages of the trash-receiving shopping bag containers mentioned heretofore and many novel features that result in a new trash-receiving shopping bag device which is not anticipated, rendered obvious, suggested, or even implied by any of the prior art trash-receiving shopping bag containers, either alone or in any combination thereof.

Still another object of the present invention is to provide a new trash-receiving shopping bag device for allowing the user to reuse the plastic bags received while shopping at retail stores.

Still yet another object of the present invention is to provide a new trash-receiving shopping bag device that is easy and convenient to set up and use.

Even still another object of the present invention is to provide a new trash-receiving shopping bag device that eliminates unnecessary waste of the shopping bags and instead of simply throwing them away after shopping, the user can continue to use them for receiving trash.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
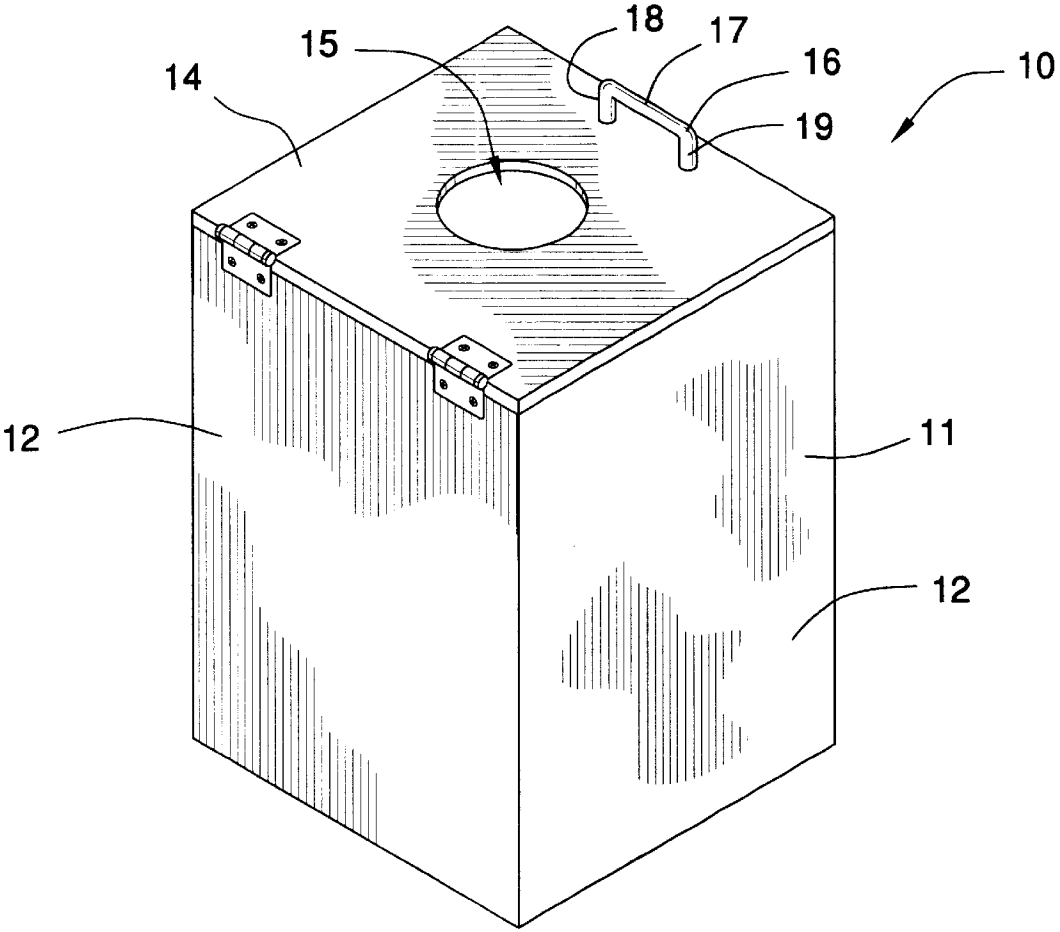
FIG. 1 is a perspective view of a new trash-receiving shopping bag device according to the present invention.
Figure 3:
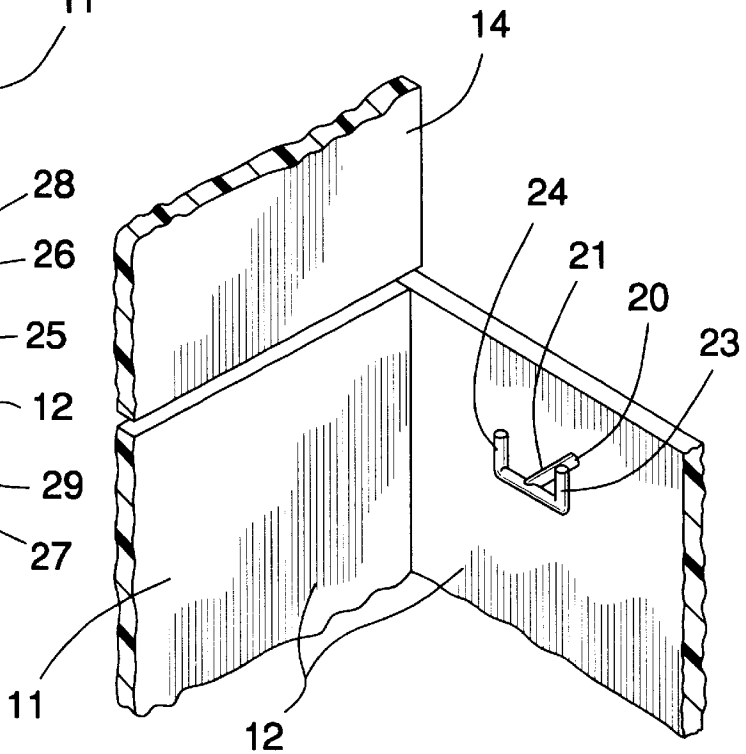
FIG. 3 is a partial perspective view of the present invention.
Figure 2:
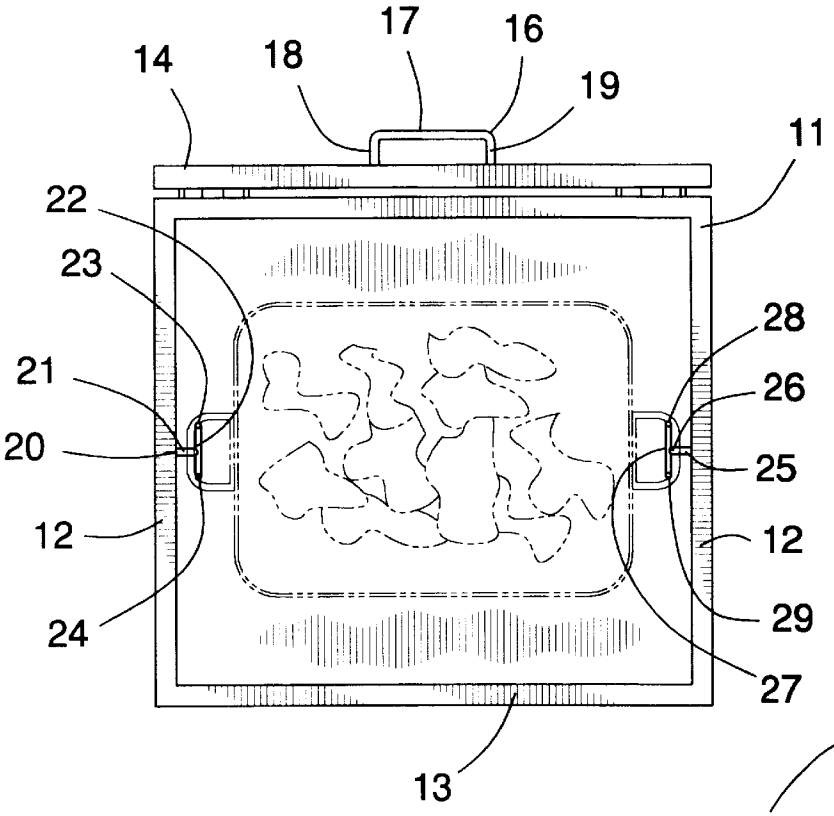
FIG. 2 is a top plan view of the present invention shown in use.
Figure 4:
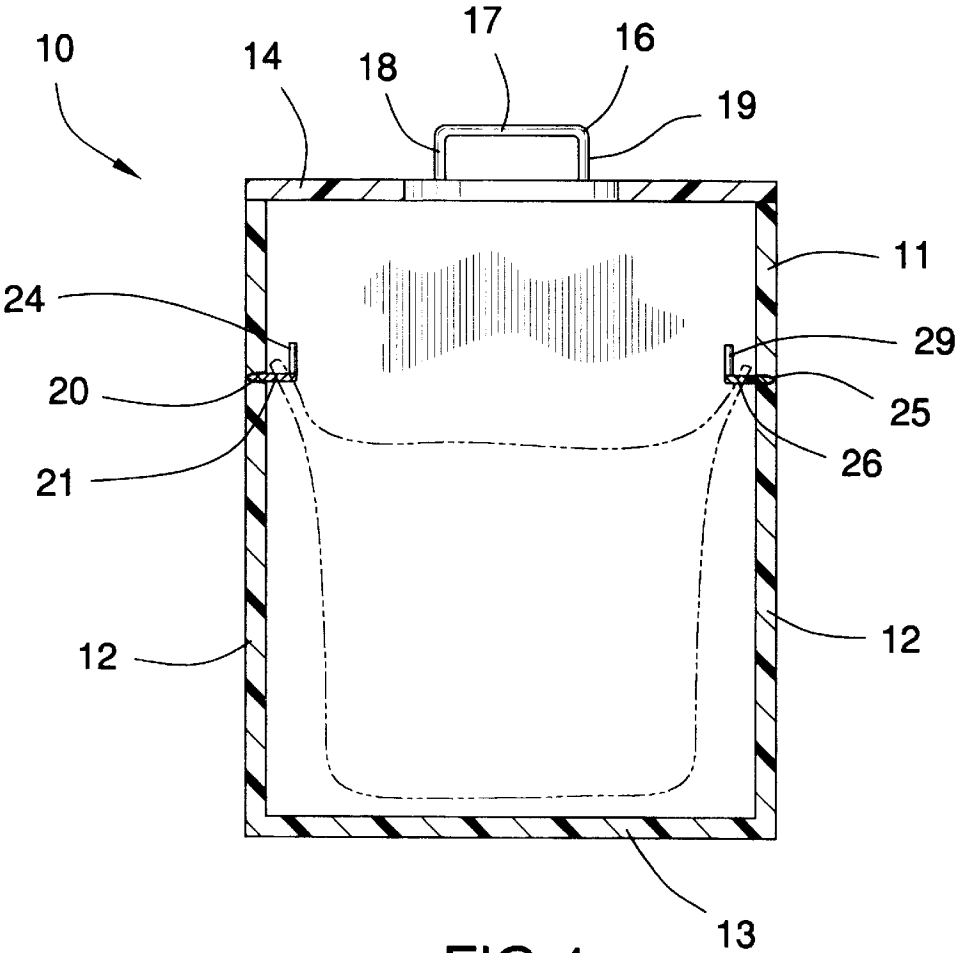
FIG. 4 is a cross-sectional view of the present invention.

With reference now to the drawings, and in particular to FIGS. 1 through 4 thereof, a new trash-receiving shopping bag device embodying the principles and concepts of the present invention and generally designated by the reference numeral 10 will be described.

As best illustrated in FIGS. 1 through 4, the trash-receiving shopping bag device 10 generally comprises a container 11 having bottom and side walls 12, 13, and also having an open top. A lid 14 is hingedly attached to the container 11. The lid 14 has a trash-receiving opening 15 being centrally-disposed therethrough and has a back edge which is hingedly attached with hinge members to a top edge of one of the side walls 12 of the container 11. A handle 16 is conventionally attached to the lid 14. The handle 16 is securely attached to a top side and near a front edge of the lid 14, and has an elongate main portion 17 and angled end portions 18, 19 which are securely and conventionally attached to the lid 14 with the elongate main portion 17 being spaced from the lid 14.

A plurality of shopping bag support members 20,25 are conventionally attached to the side walls 12 and are spaced above the bottom wall 13 inside the container 11. The shopping bag support members 20,25 include a first shopping bag support member 20 being conventionally attached to one of the side walls 12 of the container 11, and also include a second shopping bag support member 25 being opposedly and conventionally attached to another of the side walls 12 of the container 11. Each of the first and second shopping bag support members 20,25 includes an elongate anchor member 21,26 being disposed generally perpendicular to a respective side wall 12 and having a first end being securely and conventionally attached to the side wall 12, and also includes a hook member having an elongate main portion 22,27 which is securely and conventionally attached to a second end of the elongate anchor member 21,26 and also having end portions 23,24,28,29 which are angled upwardly relative to the elongate main portion 22,27 with the elongate main portion 22,27 being disposed generally perpendicular to the elongate anchor member 21,26 and with the hook member being adapted to support a handle loop of a shopping bag.

In use, the user opens the lid 14 and places the handle loops of the shopping bag over the hook members, and closes the lid 14, and the user places trash in the shopping bag through the opening 15 through the lid 14. When the shopping bag is full, the user replaces it with another shopping bag.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the trash-receiving shopping bag device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trash-receiving shopping bag device comprising:

a container having bottom and side walls, and also having an open top;

a lid being hingedly attached to said container, said lid having a trash-receiving opening centrally-disposed therethrough has a back edge which is hingedly attached with hinge members to a top edge of one of said side walls of said container;

a handle being attached to said lid, said handle being securely attached to a top side and near a front edge of said lid, and having an elongate main portion and angled end portions which are securely attached to said lid with said elongate main portion being spaced from said lid; and a plurality of shopping bag support members being attached to said side walls and being spaced above said bottom wall inside said container, said shopping bag support members including a first shopping bag support member being attached to one of said side walls of said container, and also including a second shopping bag support member being opposedly attached to another of said side walls of said container, each of said first and second shopping bag support members including an elongate anchor member being disposed generally perpendicular to a respective said side wall and having a first end being securely attached to said side wall, and also including a hook member having an elongate main portion which is securely attached to a second end of said elongate anchor member and also having end portions which are angled upwardly relative to said elongate main portion, said elongate main portion being disposed generally perpendicular to said elongate anchor member, said hook member being adapted to supporting a handle loop of a shopping bag.

* * * * *